US005656007A

United States Patent [19]

Olson et al.

[11] Patent Number: 5,656,007

[45] Date of Patent: Aug. 12, 1997

[54] APPARATUS FOR CONSTRUCTING MULTI-PIECE CARTONS

[75] Inventors: Allen L. Olson; Kelly W. Ziegler, both of Crosby; John E. Cragun, Deerwood, all of Minn.

[73] Assignee: Riverwood International Corporation, Atlanta, Ga.

[21] Appl. No.: 326,590

[22] Filed: Oct. 20, 1994

[51] Int. Cl.[6] ..... B31B 17/02; B31B 17/26

[52] U.S. Cl. ..... 493/84; 493/90; 493/167; 493/169; 493/174; 493/151

[58] Field of Search ..... 493/84, 90, 91, 493/167, 168, 169, 177, 174, 175, 176, 114, 151, 9, 16, 27, 30, 32, 33; 271/11, 12, 99, 100, 106, 107

[56] References Cited

U.S. PATENT DOCUMENTS

| | | | |
|---|---|---|---|
| Re. 30,921 | 5/1982 | McDowell | 271/99 |
| 1,402,259 | 1/1922 | Smith | 493/68 |
| 3,269,724 | 8/1966 | Lefief | 493/167 |
| 3,635,129 | 1/1972 | Cobelo, Jr. | 493/27 |
| 3,648,574 | 3/1972 | Luke | 493/33 |
| 3,659,505 | 5/1972 | Wasyluka et al. . | |
| 3,673,928 | 7/1972 | Striplin | 493/114 |
| 4,093,207 | 6/1978 | Greenwell et al. | 271/100 |
| 4,197,789 | 4/1980 | Moen . | |
| 4,398,901 | 8/1983 | Campbell . | |
| 4,581,005 | 4/1986 | Moen . | |
| 4,596,542 | 6/1986 | Moen | 493/167 |
| 4,650,448 | 3/1987 | Urso | 493/89 |
| 5,116,290 | 5/1992 | Ross | 229/23 |
| 5,316,207 | 5/1994 | Ross et al. | 229/23 |

OTHER PUBLICATIONS

"Bliss–Matic", brochure from SWF Machinery.

*Primary Examiner*—Joseph J. Hail, III
*Assistant Examiner*—Darren Ark
*Attorney, Agent, or Firm*—Joel D. Skinner, Jr.; Steve McLary

[57] ABSTRACT

An apparatus for constructing multi-piece cartons, comprising a tray member supply hopper, a tray conveyor, a glue station, a web placement and compression station including a reciprocating placer, a preform conveyor, a forming station having at least three vertically aligned mandrels and a carton output conveyor. The apparatus process paperboard cartons for fresh produce and the like. The apparatus is operable in a cartoning mode and a preform mode wherein flat unerected carton preforms are output.

19 Claims, 11 Drawing Sheets

APPARATUS FOR CONSTRUCTING MULTI-PIECE CARTONS

BACKGROUND OF THE INVENTION

1. Field of the Invention

This invention relates to packaging apparatus and methods, and more particularly to an apparatus for constructing multi-piece containers or cartons. The cartons constructed by the apparatus of this invention are particularly useful for packaging produce such as fresh fruits and vegetables.

2. Background Information

Paperboard cartons or containers are an important packaging vehicle for vegetable and fruit producers worldwide. Tray-style paperboard containers are an especially important packaging option for growers of strawberries, blueberries, raspberries, cherries and tomatoes because they function as on-site, initial packaging means, shipment means and as retail packaging means. The containers are sturdy, stable when wet, stackable and are not fully enclosed to permit filling, contents inspection, and ventilation. This type of container also provides improved external panel spaces for high quality graphics printing and advertising. Exemplary containers are disclosed in U.S. Pat. Nos. 5,116,290 and 5,316,207, assigned to applicants' assignee. An important feature of cartons such as these, are that they comprise several separate and distinct carton components. The components are brought together and erected into a completed carton. The multi-component design of the cartons places significant design limitations and requirements on machinery for assembling and erecting the finished cartons. For example, the individual components must be brought into precise alignment or defects will likely be present in the carton.

The apparatus of the present invention provides a means of automatically constructing tray-style cartons such as those discussed above. The apparatus processes cartons at relatively high speed. The apparatus is unitary and compact, and therefore provides advantages in terms of shipping and layout on the premises of the user. Importantly, the apparatus is able to process multi-piece cartons accurately and reliably.

Although various devices and methods have been used to form cartons constructed of paperboard, corrugated paper and the like, none insofar as is known has been developed or proposed that has the structure or function of applicants' invention. Furthermore, no known device or method provides the particular advantages of applicants' invention. Finally, no known device or method is capable of processing the particular cartons discussed above.

SUMMARY OF THE INVENTION

It is an object of the present invention to provide an apparatus which efficiently and reliably processes multi-piece tray-style cartons, particularly those discussed above, and which overcomes the limitations and shortcomings of the prior art.

In a basic form, the invention provides an apparatus for constructing multi-piece cartons comprising means to supply a first blank, means to place and affix at least one second blank on the first blank, a forming station having at least two vertically aligned mandrels, and means to convey the blanks from the means to place and affix to the forming station.

In a preferred form, the invention provides a unitary, compact, adjustable apparatus for constructing unerected or erected multi-piece paperboard cartons consisting of a tray member and at least two web members, comprising:

(a) a tray hopper containing a plurality of tray members;

(b) a tray conveyor receiving a tray member from the tray hopper;

(c) means, disposed proximate the tray conveyor, to deposit a predetermined glue pattern on the tray member;

(d) a reciprocating placer/compressor receiving the tray member from the tray conveyor and placing and affixing at least two web members on the tray member to form a flat preform;

(e) a preform conveyor, intersecting the tray conveyor at a ninety degree angle and receiving the preform from the placer/compressor;

(f) a forming station disposed in-line with the preform conveyor comprising a fixed middle mandrel, a vertically movable, aligned lower mandrel which is mated with the middle mandrel in an operative mode, and a vertically movable, aligned upper mandrel which engages the preform and lowers it into the mated middle and lower mandrels in an operative mode; and (g) a carton conveyor disposed in-line with and below the preform conveyor, and receiving cartons from the forming station for output from the apparatus.

The features, benefits and objects of this invention will become clear to those skilled in the art by reference to the following description, claims and drawings.

DESCRIPTION OF THE PREFERRED EMBODIMENTS

Figure 1:
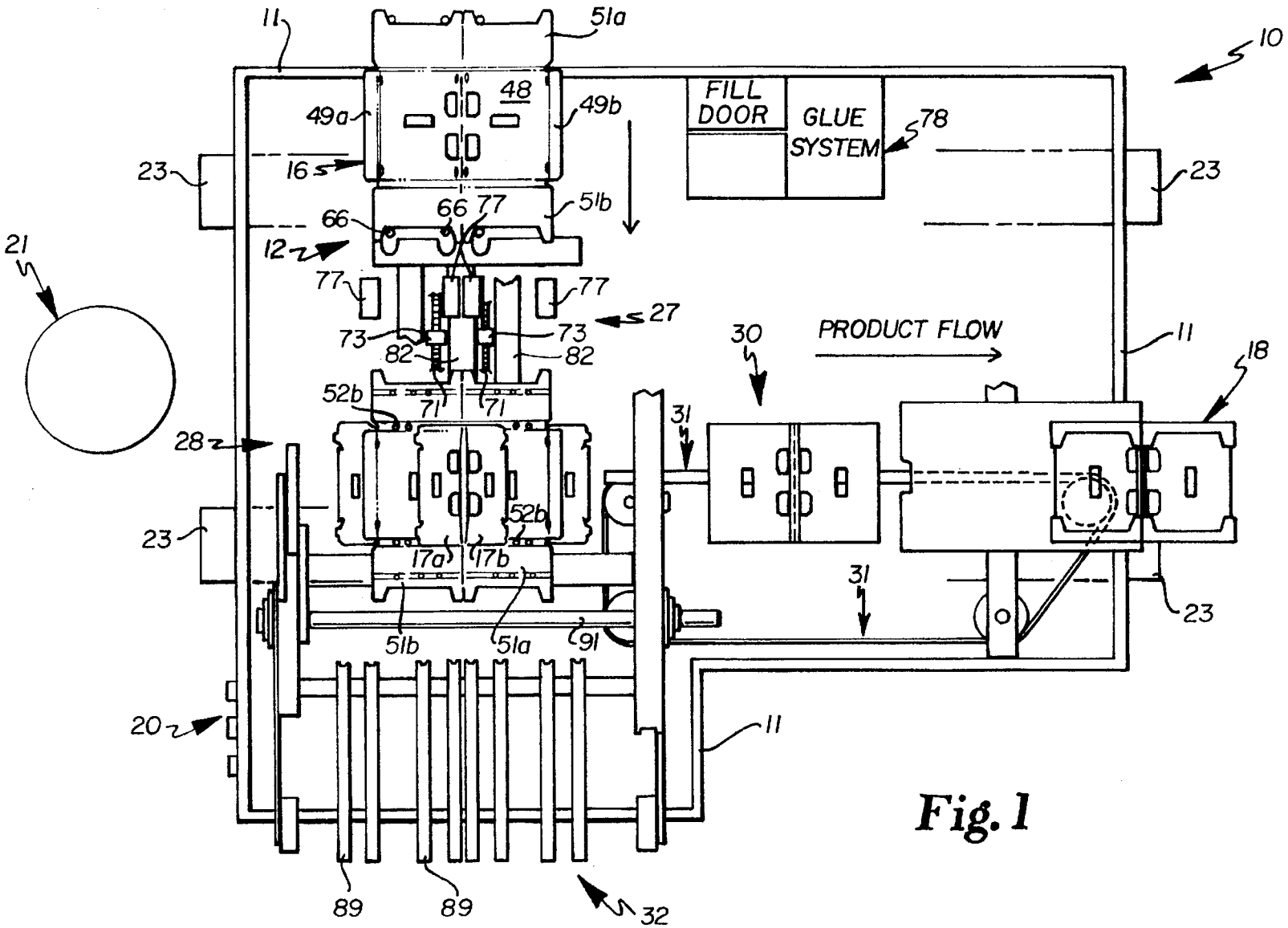
FIG. 1 is a plan view of the apparatus for constructing multi-piece cartons of the present invention.
Figure 2:
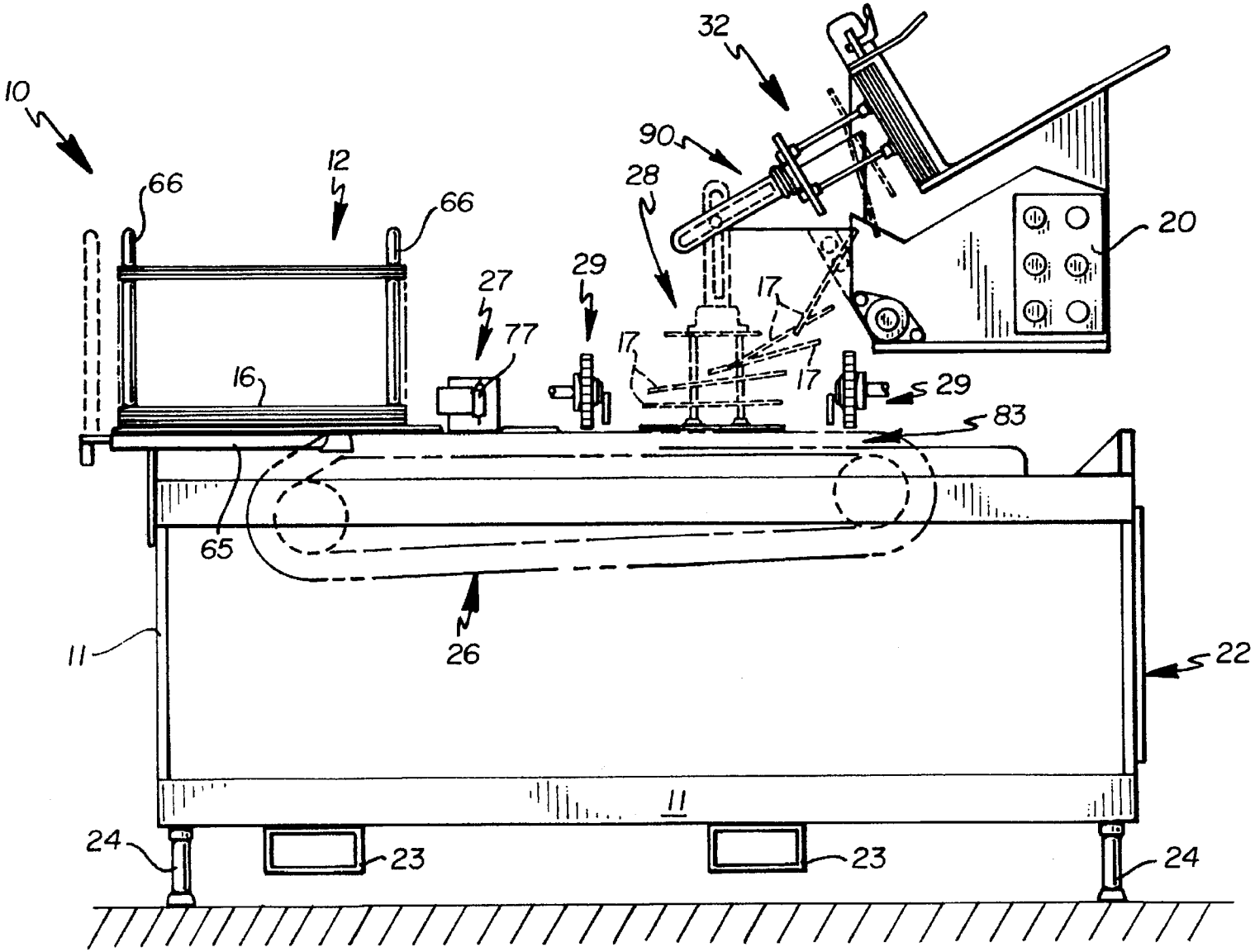
FIG. 2 is an elevation view of the apparatus taken from the left side of FIG. 1.
Figure 3:
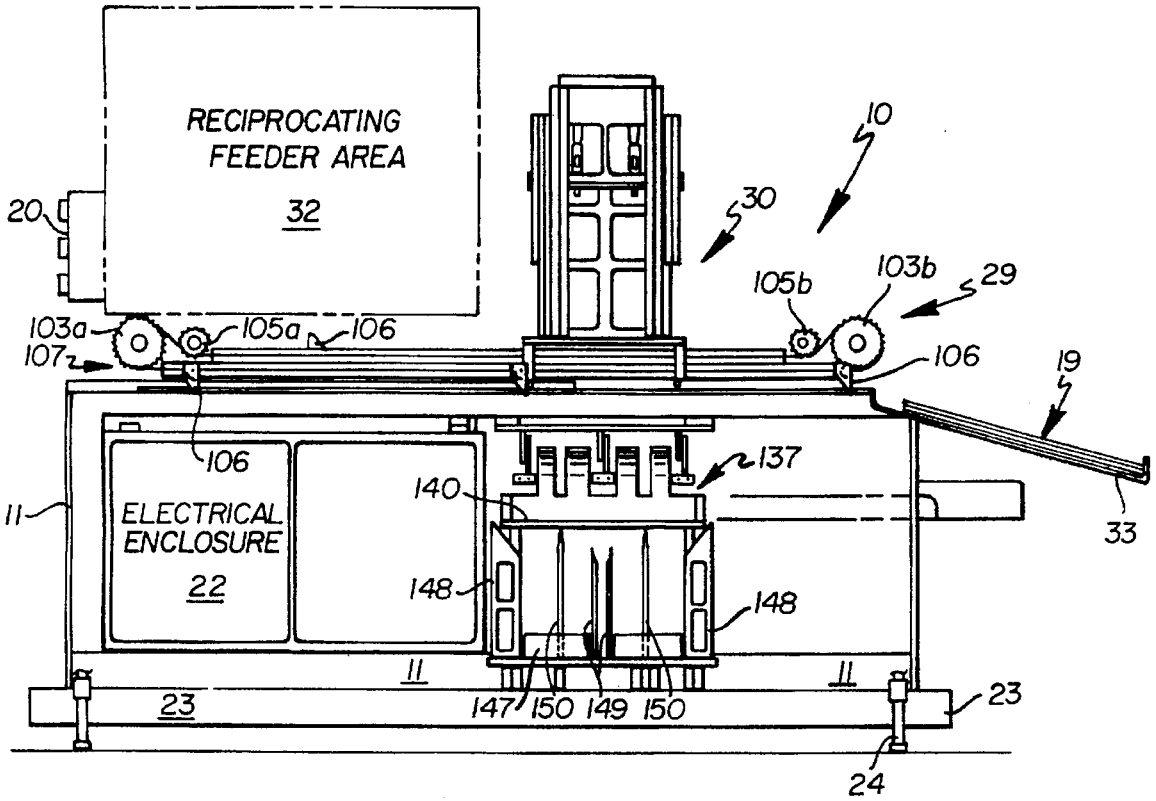
FIG. 3 is an elevation view of the apparatus taken from the front side of FIG. 1.
Figure 4:
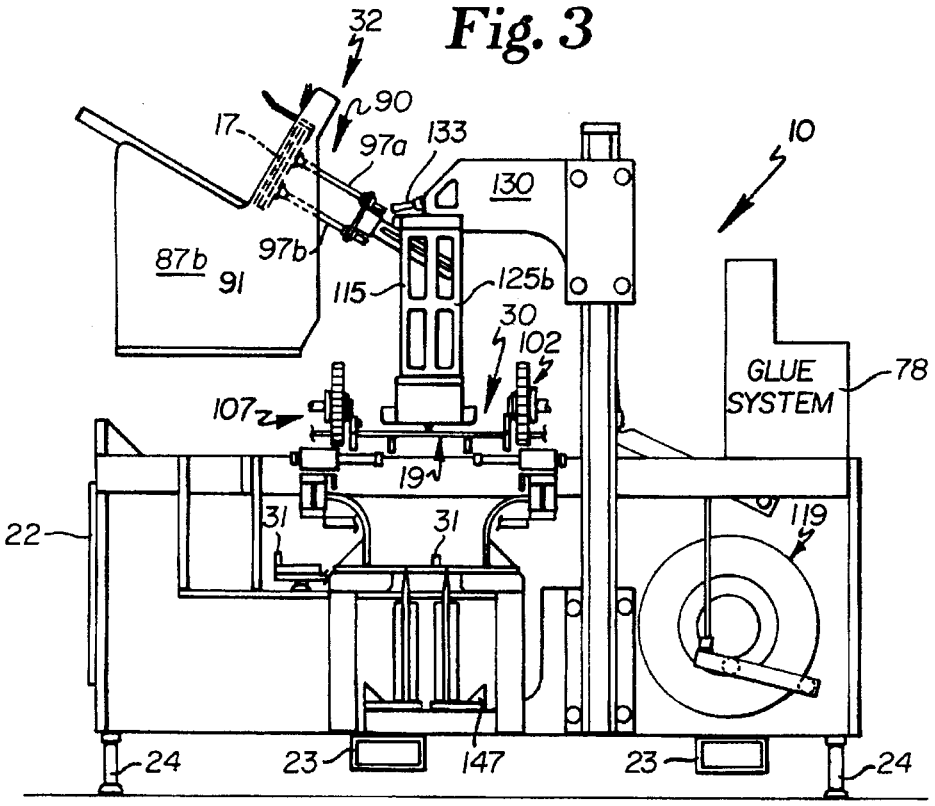
FIG. 4 is an elevation view of the apparatus taken from the right side of FIG. 1.
Figure 5:
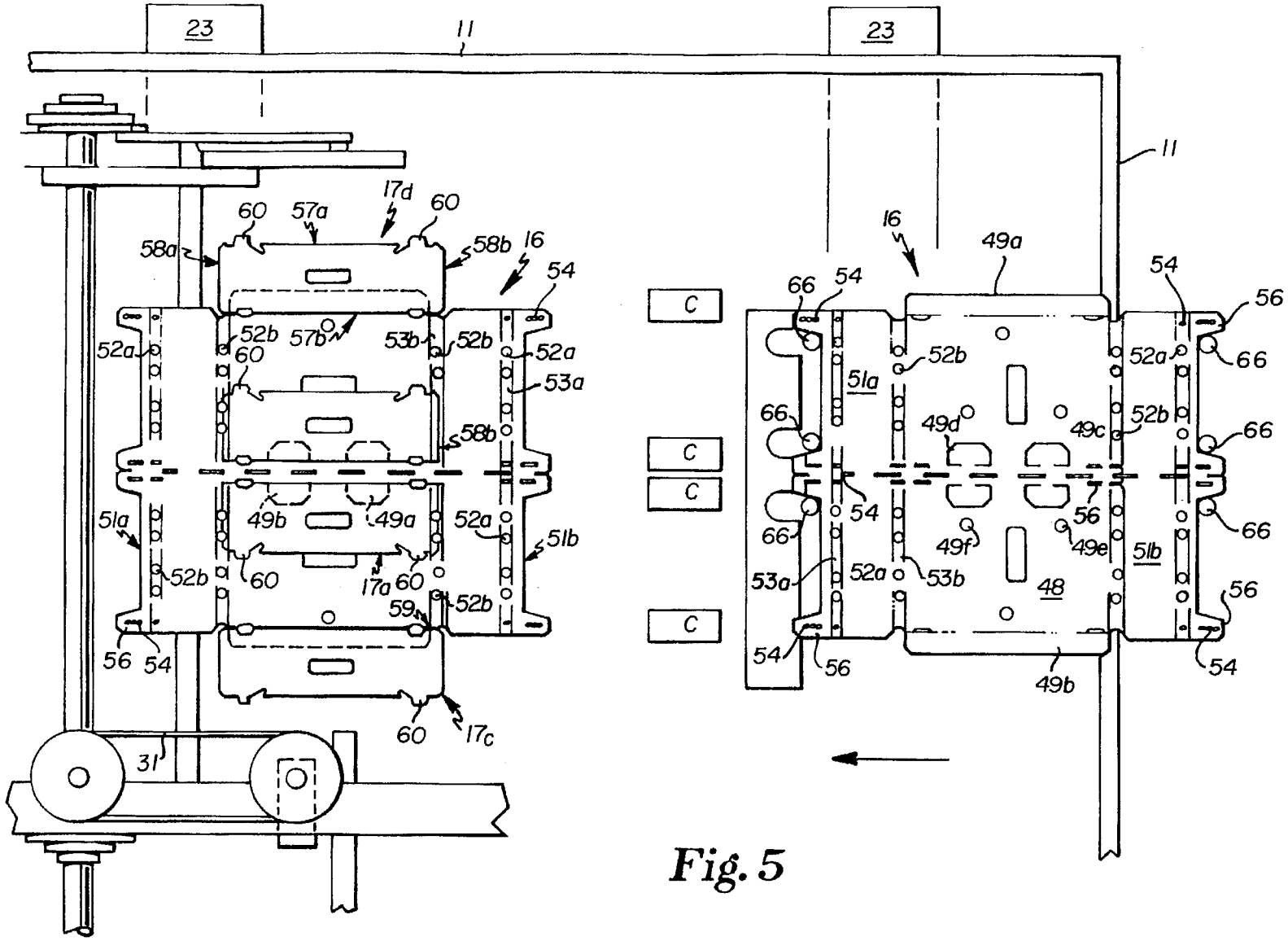
FIG. 5 is a detailed view of the initial product flow of the apparatus and showing the tray and web members.
Figure 6:
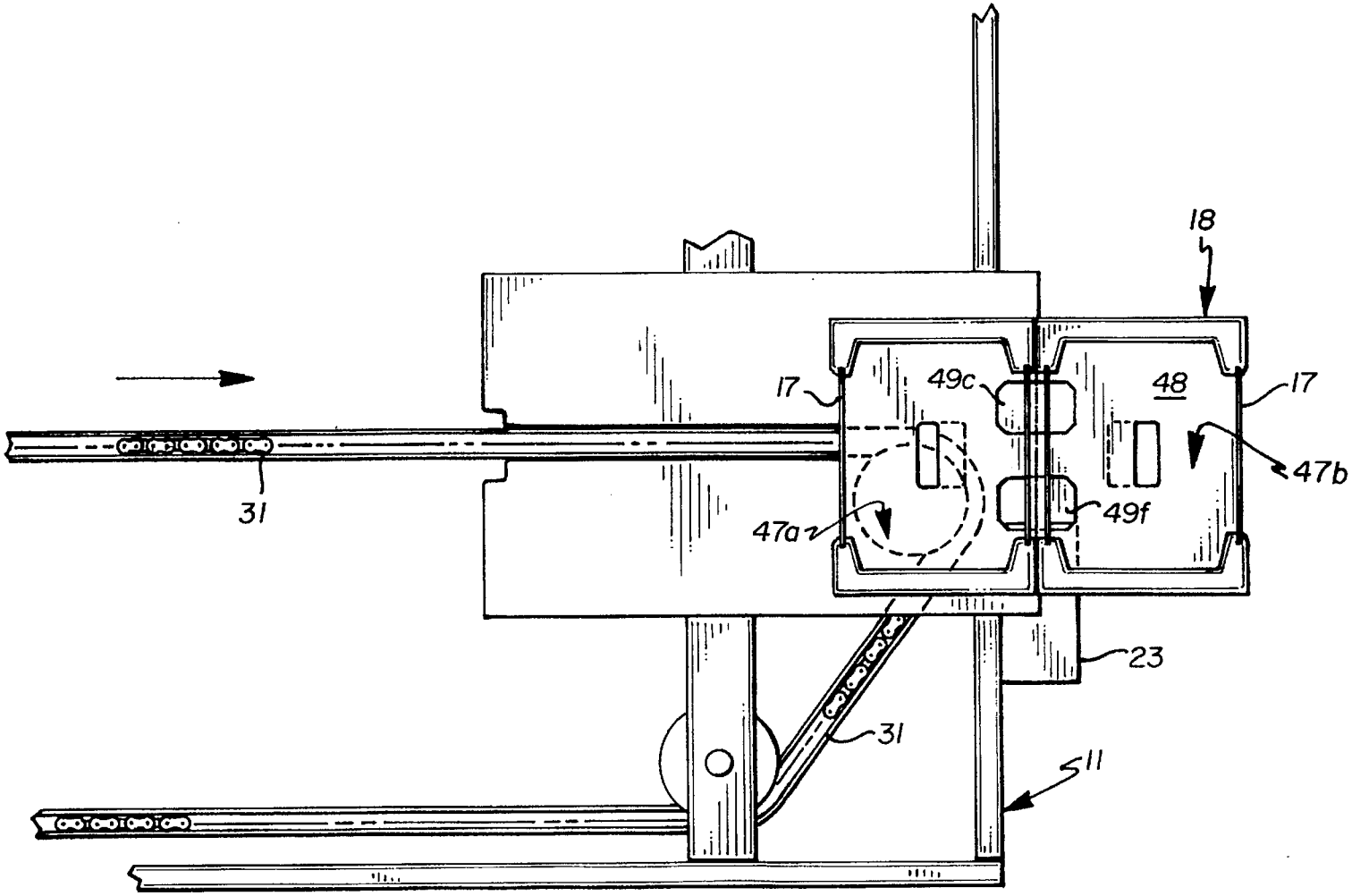
FIG. 6 is a detailed view of the final product flow of the apparatus and showing the finished carton being exiting the apparatus.

The apparatus of the present invention automatically assembles multi-piece cartons or packaging container from individual carton components. The apparatus is useable in two operating modes. In a first or carton output mode, the components are assembled, the assembled components are erected or formed into a completed carton and the completed carton is output from the apparatus. In a second or carton preform output mode, the components are attached to one another and the attached components are then output from the apparatus as a substantially flat carton preform. The preform is later erected into a completed carton at another location, for example on a grower's premises.

Referring to FIGS. 1–4, the apparatus 10 is supported by a rigid frame 11 which has a generally square configuration as viewed from the top. The frame 11 design provides a unitary and compact machine which is able to be shipped substantially assembled. This reduces shipping and set-up costs. A pair of fork receptacles 23 are mounted on the bottom of the frame 11. The fork receptacles 23 serve as a base or pallet during shipping when adjustable legs 24 are retracted, and permit ease of transportation and placement on the user's premises. In addition to the frame design, the compactness of the apparatus 10 is also due to the arrangement of its components on the frame 11 and to the product flow design. The compactness of the apparatus 10 further yields advantages in loading of carton components, maintenance and operator monitoring.

The apparatus 10 has a pair of input locations for loading of carton components, namely a tray hopper 12 and a web hopper 13. The overall apparatus 10 configuration places these input elements 12 and 13 within convenient reach of a centrally disposed operator station 21. The apparatus 10 also has a pair of output locations for discharge of completed cartons 18 and/or carton preforms 19. Both output locations are disposed on the same side of the apparatus 10, vertically aligned with one another, again for operator convenience. The apparatus 10 has a control panel 20 and electrical service enclosure 22, which are also accessible to the operator station 21.

A tray feeding conveyor 26 cyclically transports an individual tray 16 from the tray hopper 12 through a closely spaced glue station 27 at a predetermined speed for deposit of glue thereon, and to a web feeding and compression station 28 where movement of the tray is halted for a predetermined time period. At this station 28, webs 17 are deposited by a placer/compressor 32 and attached to each tray 16 to form a carton preform 19. The preform 19 is indexed and the preform conveyor 29 transports the carton preform 19 from the web feeding and compression station 28 to a forming station 30. Subsequent to indexing and transport of the preform 19 by the preform conveyor 29, a new tray 16 is indexed and transported from the tray hopper 12 to the web feeding and compression station 28. The forming station 30 forms a completed carton 18 in the carton output mode. During forming, the preform 19 is plunged downwardly, via a plurality of mandrels, from the preform conveyor 29 onto a discharge conveyor 31 which is disposed below and in longitudinal alignment with the preform conveyor 29. The cartons 18 are conveyed to a finished carton discharge hopper or other output means (not shown) by the carton discharge conveyor 31. In the preform output mode, the preforms 19 pass through the forming station 30 without being erected into a carton 18. The preform conveyor 29 transports the preforms 19 through the forming station 30 directly to a removable preform hopper 33.

Figure 10:
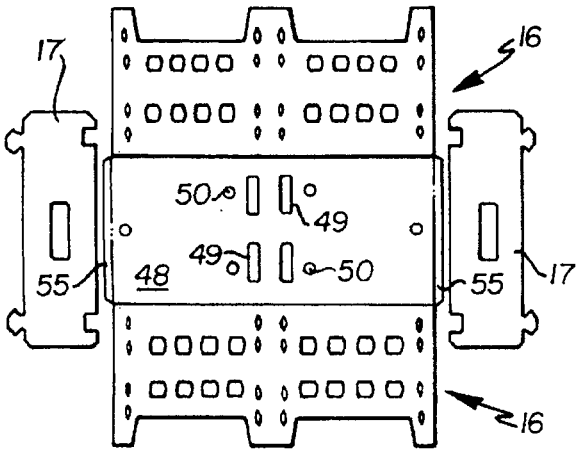
FIG. 10 is a perspective view of separated tray and web members of the carton.
Figure 11:
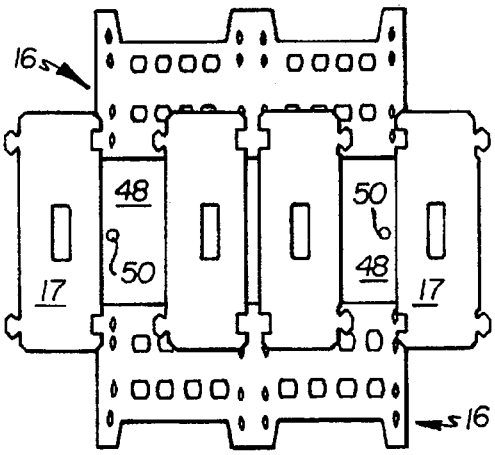
FIG. 11 is a perspective view of attached tray and web members forming a carton preform.
Figure 12:
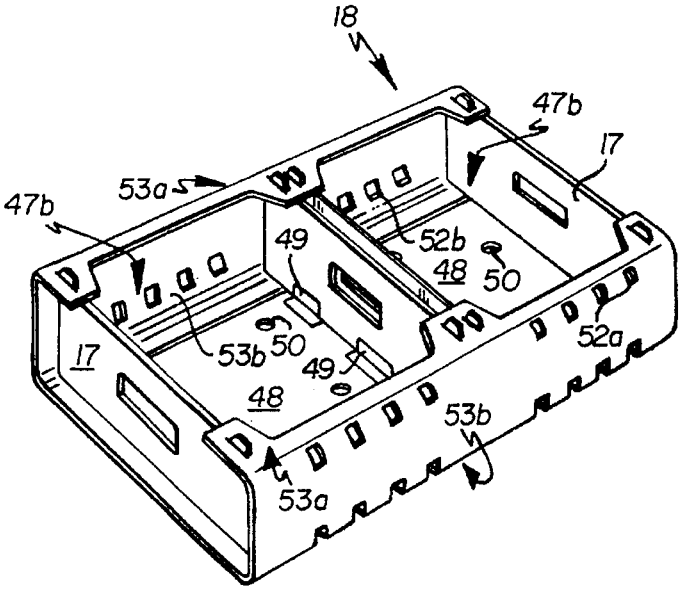
FIG. 12 is a perspective view of a carton.
Figure 13:
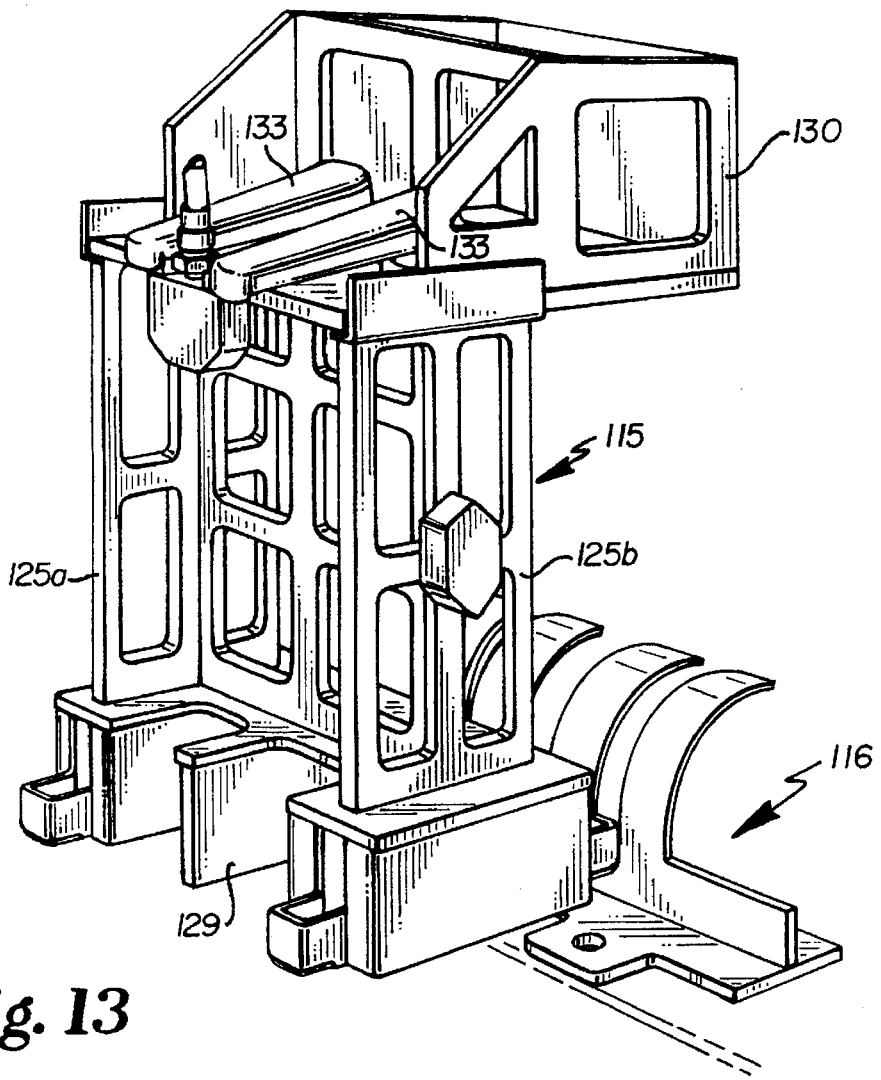
FIG. 13 is a perspective view of the upper mandrel of the forming station.
Figure 14:
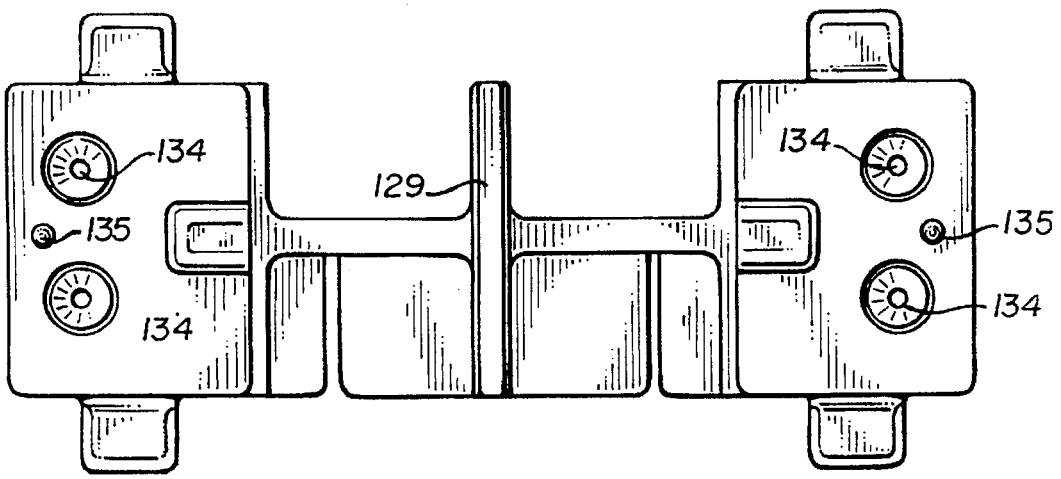
FIG. 14 is a bottom view of the upper mandrel.
Figure 15:
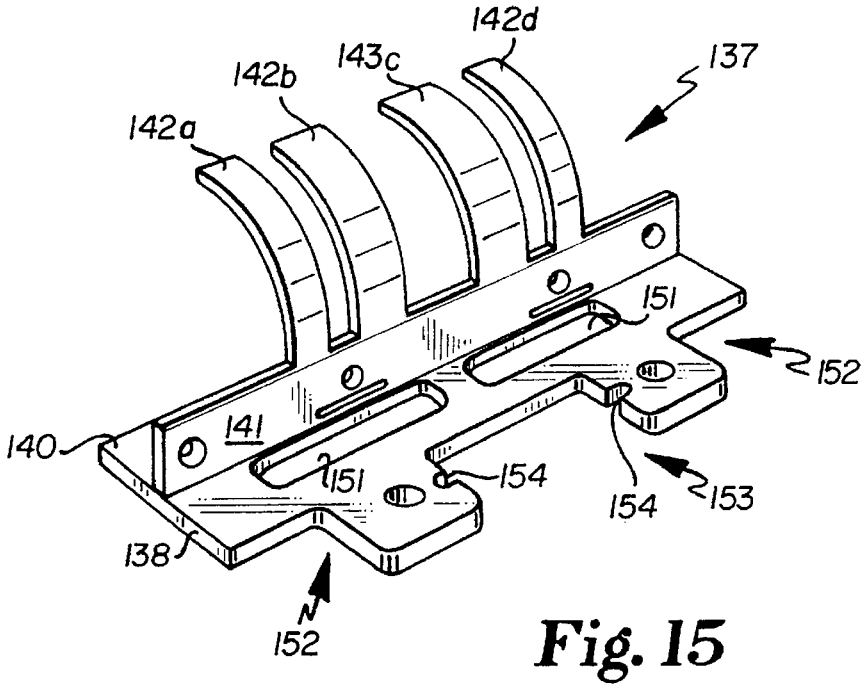
FIG. 15 is a perspective view of a portion of the middle mandrel of the forming station.
Figure 16:
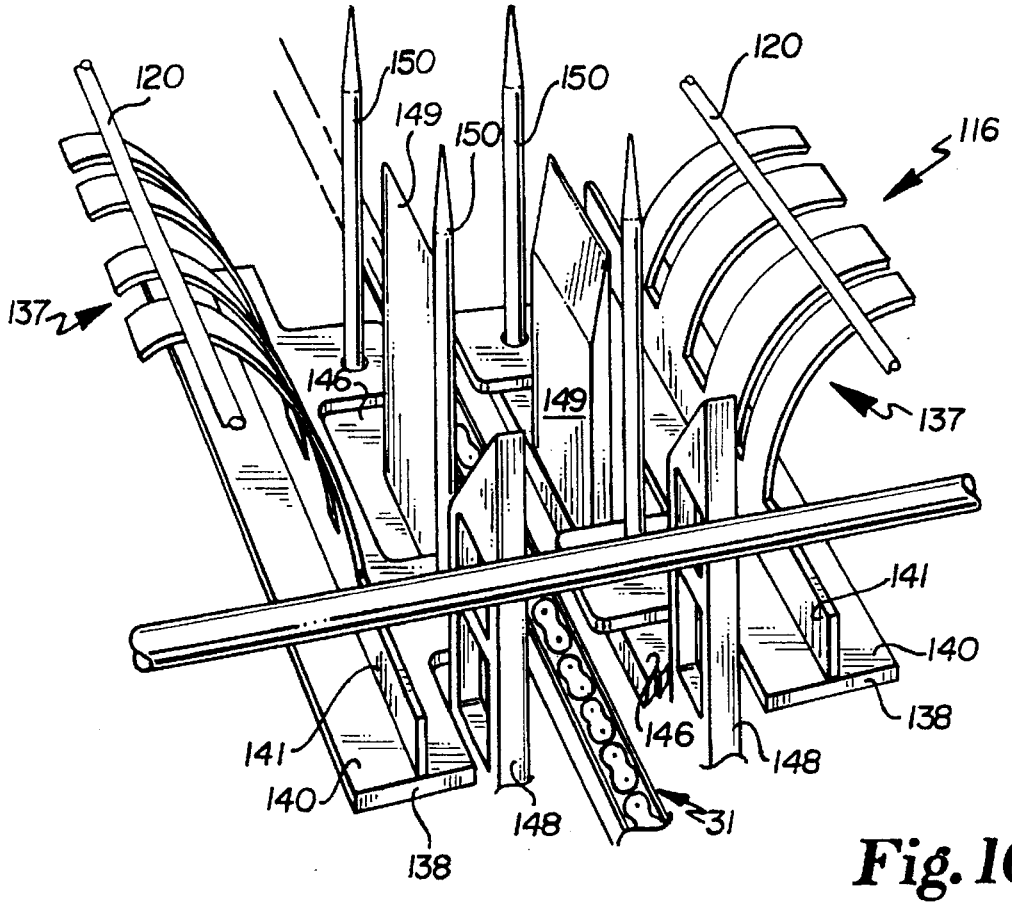
FIG. 16 is a top view of the mated middle and lower mandrels.

Referring to FIGS. 5, 6, and 10–12, the paperboard multi-piece carton 18 shown is a twelve pint container that is particularly well suited for berries. The carton 18 is rectangular, somewhat flat, open at its top and has a pair of compartments 47*a* and *b*. The carton 18 comprises a relatively wide tray member 16 and four web or panel members 17*a–d*. The two middle webs 17*a* and *b* separating the compartments 47*a* and *b* enable the carton 18 to be split into two six pint cartons (not shown). Additional embodiments (not shown) of this basic carton design include a six pint version having only two end webs and a single compartment, and a twelve pint version having two end webs and a single middle web dividing the carton into two compartments which are not separable. The apparatus 10 is easily and quickly adjusted to process the alternative carton embodiments. Each tray 16 has a flat base 48 with foldable members 49*a–f* and pass through apertures 50, front and back sides 51*a* and *b* with apertures 52*a* and *b* defining top and bottom edges 53*a* and *b*, and connection slots 54 in fold-over tabs 56. The web panels 17 have top and bottom long ends 57*a* and *b*, front and back short ends 58*a* and *b*, bottom notches 59 and top tabs 60. As is shown in FIG. 10, glue strips are deposited on foldable members of the tray 16. Referring to FIG. 11, each web 17 is placed so that one side of its bottom long edge contacts the glue strip of a foldable member. The webs 17 are placed flat with respect to the tray. After a predetermined compression and cure period on the order of one second, the webs 17 are moved to a vertical position and the sides of the tray 16 are folded over the web 17 short end so that the connection slots 54 mate with the web tab 60 and corners of the web 17 to form a locked completed carton as shown in FIG. 12.

Figure 9:
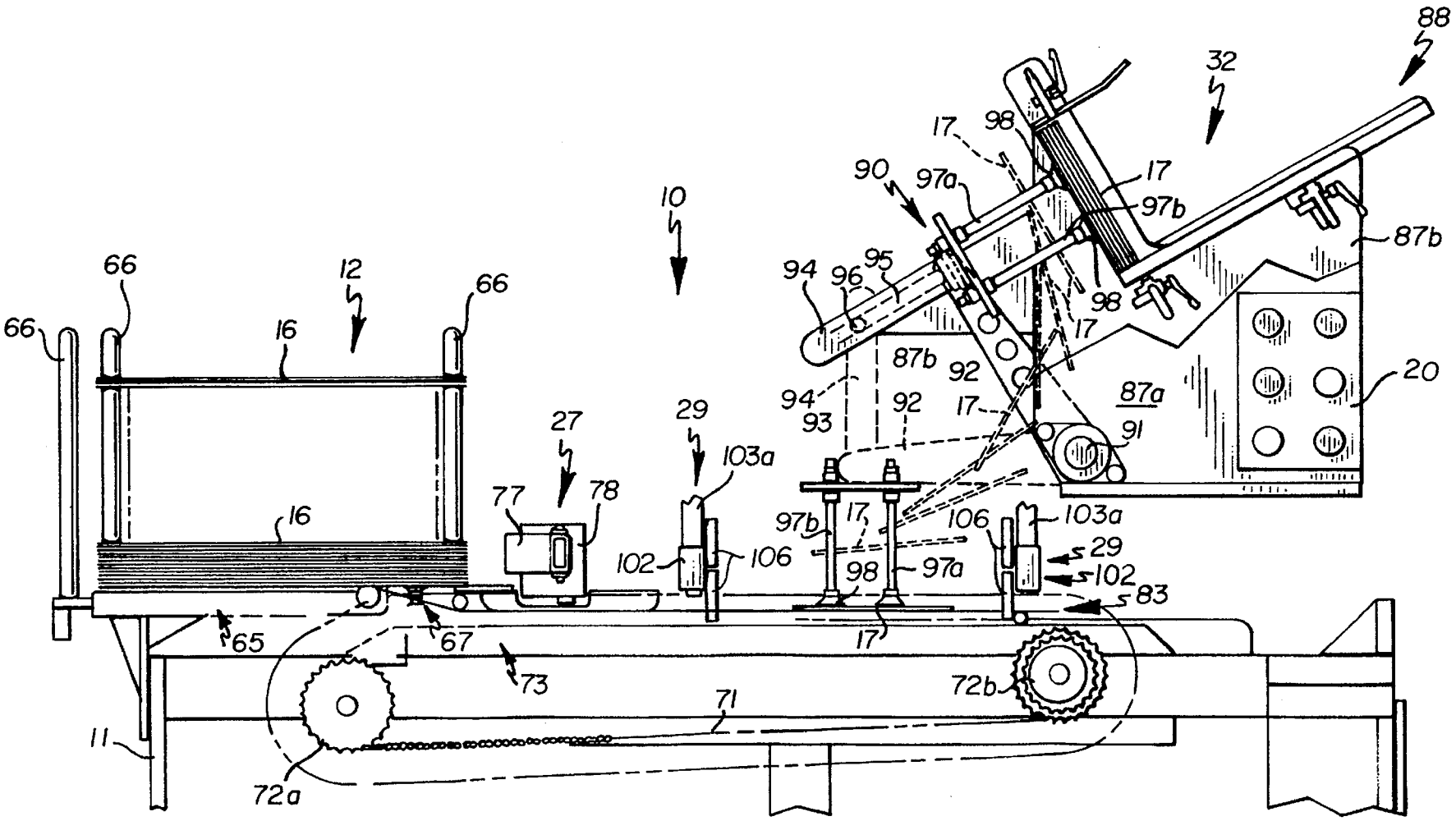
FIG. 9 is a detailed side view of the tray hopper, tray feeder conveyor, glue station and web feeding and compression station.

Referring again to FIGS. 1 and 2 and to FIG. 9, the tray hopper 12 includes a roller base 65, retainer posts 66, and a vacuum pick mechanism 67. The tray hopper 12 holds a vertical stack of flat trays 16. Trays 16 are loaded from the top and picked and horizontally ejected from the bottom of the hopper 12. The roller base 65 provides a low friction surface across which the bottom-most tray slides after it is gasped by the vacuum pick mechanism 67 and placed into engagement with the tray feed conveyor 26.

The tray feed conveyor 26 extends, and transports trays 16, from a point proximate the tray hopper 12, through the glue station 27, and to the web feeding and compression station 28. The conveyor 26 comprises a pair of spaced, parallel side by side chains 71 (only one shown) disposed about drive and idler sprockets 72*a* and *b*. The sprocket pairs 72*a* and *b* rotate about common horizontally disposed shafts. At least one engagement member 73 is attached to each chain 71, the engagement member 73 having angled teeth which extend through the complementary upper side apertures 52*a* of the tray 16 and pull it along the forward travel path of the chains 71. The conveyor 26 moves at a predetermined rate pulling the tray 16 under the glue station 27 where glue is deposited in predetermined strips as discussed above. The conveyor 26 has a predetermined dwell period where the tray 16 stays in position at the web feeding and compression station 28. At this position, two or more webs 17 are placed on the tray 16 and compressed for approximately one second to allow the glue to cure and bond the webs 17 to predetermined foldable components of the tray 16. At the conclusion of the dwell period, the forward edge 51*a* of the tray 16 is lifted upwardly a slight distance by a pivotal member 83 to allow the engagement member 73 teeth to clear the apertures 52*a* and return to a position for pickup of additional trays 16 from the hopper 12.

The glue station 27 comprises four glue guns 77 disposed in side by side alignment at a predetermined position and height above the conveyor 26. Due to the design of the hopper 12, conveyor 26 and glue guns 77, the glue station is allowed to be closely spaced to the hopper 12, which enhances the compactness of the apparatus 10. The glue guns 77 are connected to a glue supply 78 such as a Nordson 3100 glue system. The glue station 27 deposits glue strips 55 of a desired orientation on the top surface of the passing tray 16.

The web feeding and compression station 28 comprises essentially the terminal end portions of flat base supports 82 which are coextensive with the tray conveyor 26 and support the trays 16, the web feeder/compressor 32 which places webs 17 in position on the trays 16, and the pivoting guide mechanism 83 which lifts the front edge 52*a* of each tray 16 to disengage it from the tray conveyor 26. The web feeder/compressor 32 comprises parallel spaced pairs of coupled frame members 87*a* and *b*, a web magazine 88 including passive operator aligning web holders 89, and preferably a vacuum actuated reciprocating placement mechanism 90. Alternatively, a bottom blank feeding mechanism may be used. The placement mechanism 90 comprises a vacuum control mechanism of a design generally known in the art, a first pivot shaft 91 connected to the frame members 87*a*, a pair of first arms 92 which are pivotally attached at their lower ends to the first shaft 91, a second shaft 93 pivotally connected to the opposite end of the first arms 92, and a pair of second arms 94 including a slide channel 95 which is slidingly coupled to the outwardly extending end of frame 87*b* via a follower 96. Four pairs of vacuum actuated engagement arms 97*a* and *b*, of a design known in the art, are fixed to the second shaft 93, each pair of arms 97*a* and *b* being assigned to one web holder 89 and each arm having a cup-type vacuum engagement head 98 for contact with the web 17. As is best shown in FIG. 9, the placer 90 reciprocatingly engages two or more webs 17 from the magazine and by pivoting about the arms 91 and 93, and via sliding movement of the follower 96 in the channel 95, moves the webs 17 from their initial generally vertical position thereat to a final horizontal position in compressing contact with a tray 16 disposed on the terminal ends of the supports 82 in the web feeding and compression area 28.

Figure 7:
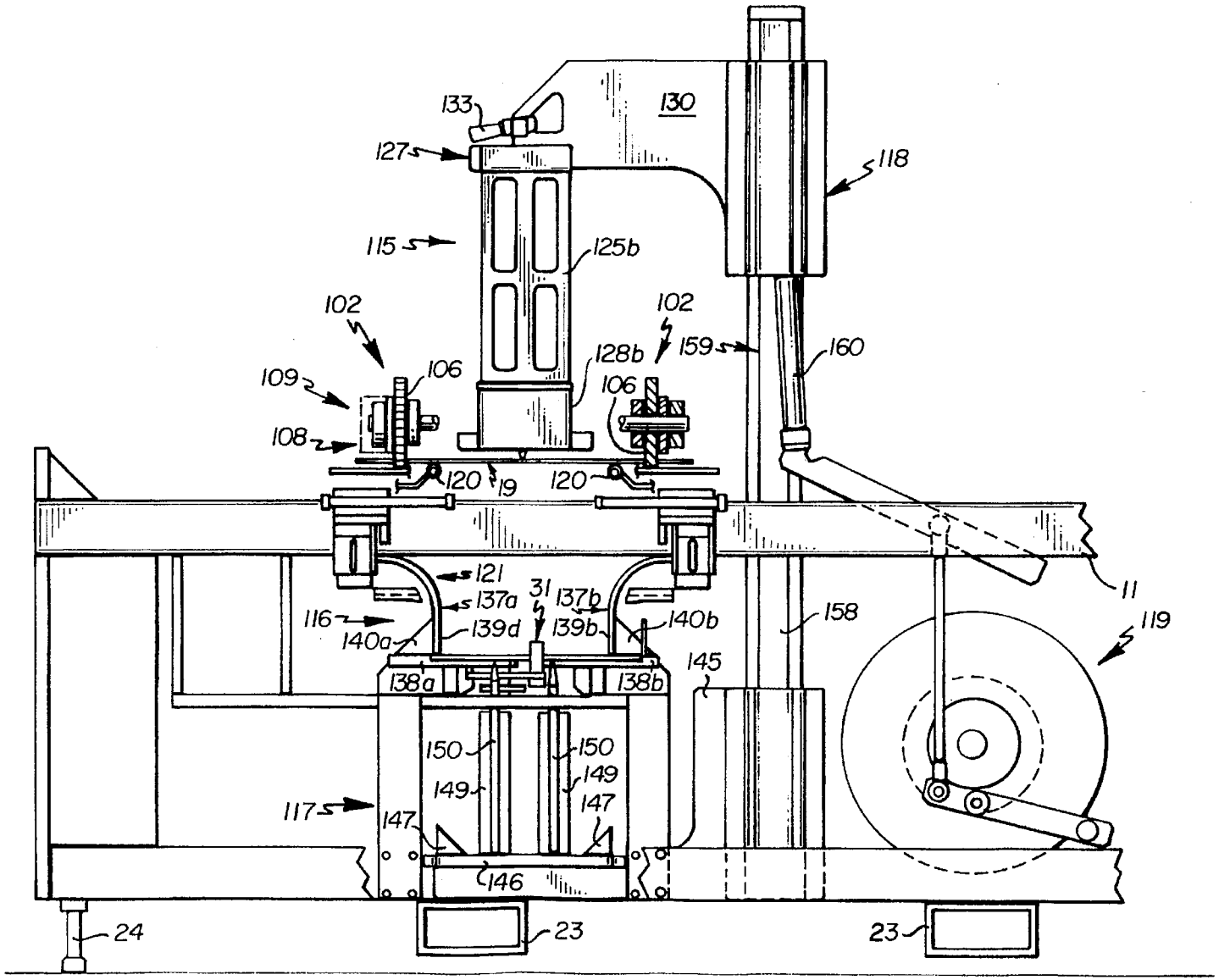
FIG. 7 is a detailed view of the forming station of the apparatus taken in-line with the final product flow.
Figure 8:
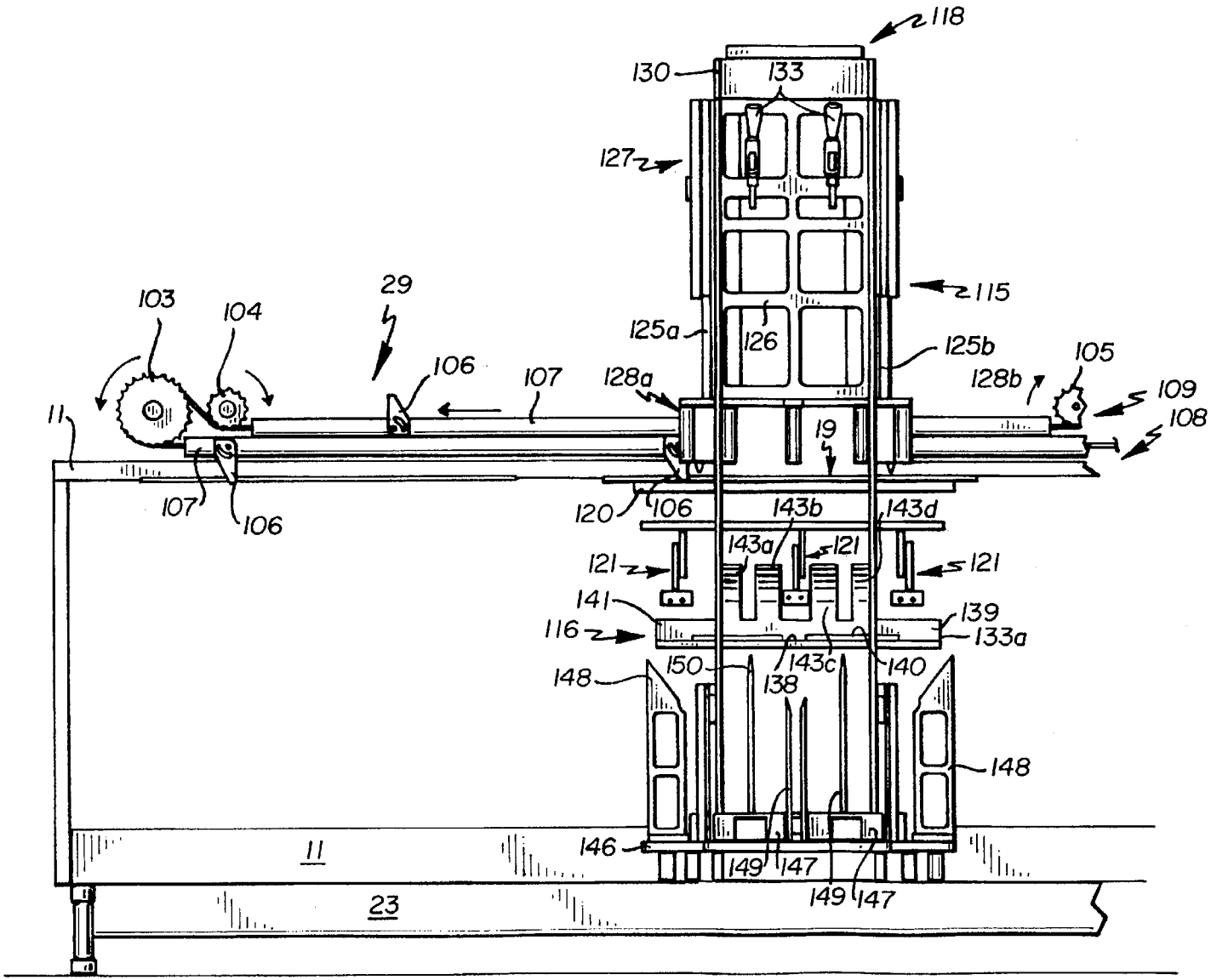
FIG. 8 is a detailed view of the forming station taken at a ninety degree angle with respect to FIG. 7.

Referring to FIGS. 7 and 8, the preform conveyor 29 is aligned at a ninety degree angle with respect to the longitudinal orientation of the tray conveyor 26. The preform conveyor 29 extends, and transports the preform 19, horizontally and longitudinally from the web placement and compression station 28, through the forming station 30 and to the preform hopper 33. In a carton forming mode, the preform is removed from the conveyor 29, erected into a carton 18 at the forming station 30 and discharged by the discharge conveyor 31. The conveyor 29 comprises a pair of elongated, parallel spaced and synchronously driven flight members 102. Each flight member 102 comprises drive and idler sprockets 103*a* and *b* which are rotatable around horizontally oriented shafts, a chain guide 107, an endless chain 104 which rotates about the sprockets 103*a* and *b*, take-up sprockets 105*a* and *b*, and a plurality of flights 106. Importantly, the flight members 102 are spaced apart such that the flights 106 engage the trailing end portion, namely the web 57*a*, of the preform proximate the outward edges thereof. Hence, the conveyor 29 does not obstruct the forming station 30 and permits the preform 19 to be pushed downwardly from and essentially through the conveyor 29, as is discussed in detail below. Preferably, a lower run 108 of the chains 104 moves the flights 106 forward and an upper run 109 provides a return path for the flights 106.

The forming station 30 basically comprises first, second and third mandrels 115, 116 and 117, respectively, a vertical actuation carriage 118 to which the first and third mandrels 115 and 117 are attached, a drive mechanism 119 which powers the upper and lower mandrels 115 and 116 on the carriage 118, drop-away support rods 120 which are pivotally attached to the frame 11, and locking fingers 121. In operation, firstly a preform 19 is transported by the preform conveyor 29 and aligned with the forming station 30. In this position, the preform 19 rests on the support rods 120 which are in a horizontal position. Secondly, the third or lower mandrel 117 moves up and mates with the second or middle mandrel 116. Thirdly, the first or upper mandrel 115 moves down, engages the preform 19 and drives it downwardly though the rods 120, which fall away, and into the mated middle and lower mandrels 116 and 117 which causes the preform to become substantially folded into a carton configuration. Fourthly, the locking fingers 121 move inwardly and engage predetermined portions of the preform 19 to lock them into place yielding a completed carton 18. Finally, the lower mandrel 117 descends to its initial level taking the carton 18 with it. In this position, the carton 18 is free of the preform conveyor 29, and is then engaged by the carton conveyor 31 for output. After each forming cycle, the forming station is reset whereby the upper mandrel 117 and the support rods 120 return to their initial positions.

Referring to FIGS. 7, 8, 13 and 14, the upper mandrel 115 is disposed above the middle mandrel 116, and is connected to the carriage 118. The upper mandrel 115 moves down in the forming process, engaging a preform 19 on the preform conveyor 29 and moving it down into the middle mandrel 116. The upper mandrel 115 comprises a pair of side frames 125*a* and *b*, a middle frame 126, an upper bracket 127, a pair of side heads 128*a* and *b*, and a middle head 129. The mandrel 115 shown is for processing the twelve pint, dual compartment, splittable cartons 18. The upper mandrel 115 is connected to the carriage 118 via a vertically movable connection bracket 130. The side and middle heads 128*a* and *b* and 129 are for contact with the preform 19 to move it downwardly into the middle mandrel 116. The side heads 128*a* and *b* have a generally rectangular comet surface, each with a pair of downwardly disposed vacuum grasping cups 134 and an alignment prong 135. This configuration ensures that the heads 128*a* and *b* positively and firmly engage the preform 19 and hold it in a fixed, laterally stable, horizontal position as the preform 19 is forced down into the middle mandrel 116. The upper bracket 127 has hand operable levers 133 which enable removal of the upper mandrel 115 for processing change-over to a different style of carton. The total weight of the mandrel 115 and bracket 130 is on the order of seventy-five pounds. The mass of the mandrel 115 and bracket 130 alone provide the downward force on the preform 19, and, as is discussed below, the carriage 118 does not actively downwardly move the aforementioned assembly.

Referring also to FIGS. 7, 8, 15 and 16, the middle mandrel 116, also called a forming shroud or shoe, is disposed in a fixed position in the forming station 30, level with the container discharge conveyor 31. The mandrel 116 comprises a pair of halves 137*a* and *b*, each of which has a flat, horizontally disposed base plate 138 and an upwardly oriented side member 139 which is attached to the base 138 via a bracket 140. The side members 139 have a flat lower portion 141 and outwardly curved, spaced upper portions 142*a–d*. The horizontal dimensions of the combined bases 138 of the middle mandrel 116 halves 137 is equivalent to the horizontal dimensions of the completed carton 18. The bases 138 have a plurality of apertures which permit upward extension of various elements of the lower mandrel 117 therethrough as described further below. The curvature of the upper portions 142*a–d* of the side member 139 guide the downwardly plunging preform 19 toward the bases 138, or center of the mandrel 116, thereby centering the tray base 48 on the bases 138 and vertically erecting the sides 51 during the forming process. The middle mandrel 116 shown is utilized to form the version of the carton discussed above.

Referring to FIGS. 7, 8, 15 and 16, the lower mandrel 117 is disposed below the middle mandrel 116 and connected to the carriage 118. As the initial step in a forming process, and prior to actuation of the upper mandrel 115, the lower mandrel 117 is moved upwardly by the carriage 118 and mates with the middle mandrel 116. A carton 18 is formed by the action of the upper mandrel 115 lowering the preform 19 into the mated lower and middle mandrels 117 and 116. The completed carton 18 lowers as the lower mandrel 117 descends from the mated position, whereby the carton 18 is engaged by the discharge conveyor 31. The lower mandrel 117 comprises a carriage connection bracket 145, a flat base 146, side members 147, end members 148, central members 149 and prongs 150. The side members 147 are short block-like structures with an inwardly disposed beveled edge which are fixed to the base 146. In a forming mode, the members 147 extend upwardly through apertures 151 in the middle mandrel base 138 to engage and form the tray edges 53*b* as the preform 19 is brought down onto the lower mandrel 117 elements by the action of the upper mandrel 115. The end members 148 are tall, channeled structures with inwardly beveled edges which are fixed to the base 146. In a forming mode, the members 148 extend upwardly through end notches 152 in the middle mandrel base 138 to engage and vertically erect the outer, end webs 17*c* and *d* of the preform 19. The central members 149 are tall, rectangular structures with inwardly disposed beveled edges which are fixed to the base 146. In a forming mode, the members 149 extend upwardly though central notch 153 in the middle mandrel base 138 and through apertures 49 in the base 48 to finally engage and completely vertically erect the center webs 17*a* and *b* of the preform 19. The prongs 150 are tall, cylindrical structures with a pointed end which are fixed to the base 146. In a forming mode, the prongs 150 extend upwardly through apertures 154 in the middle mandrel base 138 and through pass through apertures 50 in the base 48 to initially engage and partially vertically erect the center webs 17*a* and *b* of the preform 19. The net effect of the various elements of the lower mandrel 117 is to vertically erect the webs 17 and to form the bottom edges 53*b* of the sides 51 of the preform 19. This lower mandrel 117 embodiment is utilized to form the twelve pint, two compartment separable carton 18 shown. The mandrel 117 may be modified to process other carton embodiments.

Referring to FIGS. 7 and 8, the carriage 118 basically comprises a rigid vertically disposed frame 158 and a linkage assembly 159. The connection brackets 130 and 145 of the upper and lower mandrels 115 and 117 are slidably connected to the frame 158. The linkage assembly 159 connects each bracket 130 and 145 to the drive mechanism 119. The drive mechanism 119 is cam controlled. A cylinder 160 further links the upper bracket 130 to the drive mechanism 119. As the upper mandrel 115 and bracket 130 descend under the force of their own combined weight, immediately upon encountering resistance caused by a jam or other malfunction, the cylinder 160 extends. A sensor (not shown) is connected to the cylinder 160 to sense cylinder extension due to the process jam. Upon sensing an extension, the mechanism halts the drop of the mandrel 115 to prevent damage to the other elements of the apparatus 10.

The locking fingers 121 are disposed proximate the sides of the upper portions 142 of the upper members 139 of each middle mandrel 116 half 137. Preferably, there are three fingers 121 on each side. In a forming mode, subsequent actuation of the lower and upper mandrels 115 and 117, the fingers 121 move laterally inwardly to engage the fold-over tabs 56, move them laterally inwardly and finally downwardly so that the slots 54 therein mate and lock with tabs 60 on webs 17. Preferably, the locking fingers 121 are articulated to permit a slight downward movement, at the point of full lateral extension, to lock the slots 54 over the tabs 60.

As many changes are possible to the embodiments of this invention utilizing the teachings thereof, the descriptions above, and the accompanying drawings should be interpreted in the illustrative and not the limited sense.

The invention claimed is:

1. An apparatus for constructing multi-piece cartons, comprising a tray hopper to hold and supply a plurality of flat, horizontally oriented first blank foldable tray members, said tray members being horizontally ejected in a horizontal plane from a bottom area of said tray hopper, a tray conveyor to convey tray members from said tray hopper, said tray conveyor comprising a revolving endless member having a rectilinear, forward travel path extending from a first end proximate said tray hopper to a second end and at least one engagement member having at least one tooth which engages said tray member, said apparatus further comprising means, disposed proximate said second end, to place and affix at least one second blank web member on said tray member, a forming station having at least two vertically aligned mandrels, and means to convey said tray members from said means to place and affix to said forming station.

2. The apparatus of claim 1, wherein said tray hopper comprises a low friction roller base and vacuum driven means to pick and horizontally move a single tray member from said hopper bottom.

3. The apparatus of claim 1, further comprising means to deposit glue trails at predetermined locations on said tray member, said glue trails being for affixation of said web members to said tray member, said means to deposit glue trails being disposed along said forward travel path of said tray conveyor.

4. The apparatus of claim 3, wherein said means to place and affix second blanks is a reciprocating placer, said placer comprising a frame, a web member magazine attached to said frame, a reciprocating arm assembly attached to said frame and disposed above said second end of said tray conveyor, and at least two vacuum actuated pick and release contacts coupled to said arm assembly, whereby said pick and release contacts grasp said web members from said web magazine and move said web members into position on a tray disposed on said means to convey tray members, place said web members on said tray, in contact with said glue trails, compress said web members for a predetermined glue curing time period to yield a substantially flat preform, and release said web members.

5. The apparatus of claim 1, wherein said means to place and affix blanks forms substantially flat preforms constructed of a tray member and affixed web members, and wherein said means to convey blanks is a preform conveyor with a rectilinear forward travel path disposed at a ninety degree angle with respect to said forward travel path of said tray conveyor.

6. The apparatus of claim 5, wherein said means to convey blanks comprises a pair of parallel, synchronized revolving endless members, spaced from each other a predetermined distance and each having a forward travel path extending from a first end intersecting said second end of said tray conveyor to a second end disposed beyond said forming station, and a plurality of flights which are disposed on respective said endless members, in alignment with each other, to engage said preform.

7. The apparatus of claim 6, further comprising means, disposed at an intersection between said tray and preform conveyors, to disengage said engagement member from said preform.

8. The apparatus of claim 6, wherein said forming station is disposed along and intersecting said preform conveyor, and comprises first, second and third vertically aligned mandrels, means to support and drive said mandrels, a pair of parallel, spaced fall-away preform support bars disposed in-line with said preform conveyor, and a plurality of locking fingers disposed adjacent and laterally with respect to said second mandrel to lock said preform and yield a completed carton.

9. The apparatus of claim 8, wherein said means to support and drive comprises a carriage coupled to a jam-sensing, cam controlled drive assembly.

10. The apparatus of claim 8, wherein said mandrels have predetermined cooperating carton forming configurations, wherein said second mandrel is fixed in position below said preform conveyor, wherein said third mandrel is disposed below said second mandrel in a normal position and ascends in an operative mode to mate with said second mandrel and subsequently descends, and wherein said first mandrel is disposed above said preform conveyor in a normal position and descends, under its own weight in an operative mode, to engage and downwardly move one said preform aligned on said preform conveyor, through said fall-away support bars and into said mated second and third mandrels, whereby said preform is folded into an unlocked carton forming configuration.

11. The apparatus of claim 10, wherein said locking fingers are articulated structures and move laterally and downwardly to move predetermined portions of said folded carton laterally and downwardly to form a locked, completed carton.

12. The apparatus of claim 11, wherein the apparatus has a cyclical operative mode, whereby a first tray member is ejected from said tray hopper, said tray conveyor moves said first tray member through said means to deposit glue wherein said glue trails are deposited, said first tray is indexed at said reciprocating placer wherein a first preform is formed of said tray and a plurality of webs, wherein said first preform is indexed at said forming station, a second tray member is ejected from said tray hopper and processed, and wherein said forming station engages, moves, folds and locks said preform into a carton.

13. The apparatus of claim 11, further comprising a carton conveyor disposed below and in-line with respect to said preform conveyor, said carton conveyor comprising a revolving endless member having a forward travel path extending from a first end intersecting said forming station to a second end disposed beyond said forming station, and at least one flight which engages said carton.

14. The apparatus of claim 13, wherein said apparatus is operable in a cartoning mode and in a preform mode, in said cartoning mode said forming station is active, forms said cartons by removing said preforms from said preform conveyor and outputs said cartons onto said carton conveyor, and in said preform mode said forming station is inactive and said preforms travel to said second end on said preform conveyor for output.

15. A unitary, compact, adjustable apparatus for constructing unerected or erected multi-piece paperboard cartons consisting of a tray member and at least two web members, comprising:

(a) a tray hopper containing a plurality of tray members;

(b) a tray conveyor receiving a tray member from said tray hopper;

(c) means, disposed proximate said tray conveyor, to deposit a predetermined glue pattern on the tray member;

(d) a reciprocating placer/compressor receiving the tray member from said tray conveyor and placing and affixing at least two web members on the tray member to form a flat preform;

(e) a preform conveyor, intersecting said tray conveyor at a ninety degree angle and receiving the preform from the placer/compressor;

(f) a forming station disposed in-line with said preform conveyor comprising a fixed middle mandrel, a vertically movable, aligned lower mandrel which is mated with said middle mandrel in an operative mode, and a vertically movable, aligned upper mandrel which engages the preform and lowers it into said mated middle and lower mandrels in an operative mode; and (g) a carton conveyor disposed in-line with and below said preform conveyor, and receiving cartons from said forming station for output from the apparatus.

16. An apparatus for constructing multi-piece cartons, comprising a hopper to supply a first blank tray member, means to convey tray members from said tray hopper, means to deposit glue trails at predetermined locations on said tray member, a reciprocating placer to place and affix at least one second blank web member on said first blank, said placer comprising a frame, a web member magazine attached to said frame, a reciprocating arm assembly attached to said frame and disposed above said second end of said tray conveyor, and at least two vacuum actuated pick and release contacts coupled to said arm assembly, whereby said pick and release contacts grasp said web members from said web magazine and move said web members into position on a tray disposed on said means to convey tray members, place said web members on said tray, in contact with said glue trails, compress said web members for a predetermined glue curing time period to yield a substantially flat preform, and release said web members, said apparatus further comprising a forming station having at least two vertically aligned mandrels, and means to convey said blanks from said means to place and affix to said forming station.

17. An apparatus for constructing multi-piece cartons, comprising a hopper to supply a first blank tray member, a tray conveyor for conveying tray members from said tray hopper and having a rectilinear, forward travel path extending from a first end proximate said tray hopper to a second end, means to place and affix at least one second blank web member on said first blank to form substantially flat preforms comprising a tray member and at least one affixed web member, a forming station having at least two vertically aligned mandrels, and a preform conveyor with a rectilinear forward travel path disposed at a ninety degree angle with respect to said forward travel path of said tray conveyor for conveying said blanks from said means to place and affix to said forming station.

18. An apparatus for constructing multi-piece cartons, comprising a hopper to supply a first blank tray member, means to place and affix at least one second blank web member on said first blank to form substantially flat preforms comprising a tray member and at least one affixed web member, a forming station having at least two vertically aligned mandrels, and a preform conveyor for conveying said blanks from said means to place and affix to said forming station, said forming station being disposed along and intersecting said preform conveyor, and comprising first, second and third vertically aligned mandrels, means to support and drive said mandrels, a pair of parallel, spaced fall-away preform support bars disposed in-line with said preform conveyor, and a plurality of locking fingers disposed adjacent and laterally with respect to said second mandrel to lock said preform and yield a completed carton.

19. An apparatus for constructing multi-piece cartons, comprising a hopper to supply a first blank tray member, means to place and affix at least one second blank web member on said first blank to form substantially flat preforms comprising a tray member and at least one affixed web member, a forming station having at least two vertically aligned mandrels, a preform conveyor with a rectilinear forward travel path for conveying said blanks from said means to place and affix to said forming station, and a carton conveyor disposed below and in-line with respect to said preform conveyor, said carton conveyor comprising a revolving endless member having a forward travel path extending from a first end intersecting said forming station to a second end disposed beyond said forming station, and at least one flight which engages said carton, whereby said apparatus is operable in a cartoning mode and in a preform mode, in said cartoning mode said forming station is active, forms said cartons by removing said preforms from said preform conveyor and outputs said cartons onto said carton conveyor, and in said preform mode said forming station is inactive and said preforms travel to said second end on said preform conveyor for output.

* * * * *